US005960941A

United States Patent [19]

Castonguay et al.

[11] Patent Number: 5,960,941

[45] **Date of Patent: *Oct. 5, 1999**

[54] CIRCUIT BREAKER BELL ALARM ACCESSORY WITH BOTH AUTOMATIC RESET AND LOCKOUT FUNCTION

[75] Inventors: Roger N. Castonguay, Terryville; Dean A. Robarge, Southington, both of Conn.

[73] Assignee: General Electric Company, Schenectady, N.Y.

[ * ] Notice: This patent is subject to a terminal disclaimer.

[21] Appl. No.: 08/908,767

[22] Filed: Aug. 8, 1997

[51] Int. Cl.[6] ..... H01H 73/12

[52] U.S. Cl. ..... 200/308; 200/323

[58] Field of Search ..... 200/308, 323; 340/638, 644

[56] References Cited

U.S. PATENT DOCUMENTS 3,084,238 4/1963 Baskerville ..... 200/400

3,095,489 6/1963 Baird ..... 200/400

4,167,988 9/1979 Acampora et al. ..... 185/40 R 4,672,501 6/1987 Bilac et al. ..... 361/96

5,502,286 3/1996 Pollman et al. ..... 200/401

*Primary Examiner*—Renee S. Luebke

*Attorney, Agent, or Firm*—Cantor Colburn LLP; Carl B. Horton

[57] ABSTRACT

An air circuit breaker bell alarm unit allows selection of both bell alarm accessory lock-out facility along with automatic reset function. A plunger extending from the bottom of the bell alarm accessory interacts with the circuit breaker operating components to automatically reset the bell alarm pop-up target in the early stages of the closing of the circuit breaker contacts or to lock-out the closing of the circuit breaker contacts until the pop-up target is manually reset.

16 Claims, 4 Drawing Sheets

CIRCUIT BREAKER BELL ALARM ACCESSORY WITH BOTH AUTOMATIC RESET AND LOCKOUT FUNCTION

BACKGROUND OF THE INVENTION

Air circuit breakers as described within U.S. Pat. Nos. 3,095,489 entitled "Manual Charging Means for Stored Energy Closing Mechanisms of Electric Circuit Breakers" and 3,084,238 entitled "Ratchet Mechanism for Charging a Closing Spring in an Electric Circuit Breaker" include operating mechanisms that are mainly exposed to the environment. Since the air circuit breakers are rated to carry several thousand amperes of current continuously, the exposure to convection cooling air assists in keeping the operating components within reasonable temperature limits.

U.S. patent application Ser. No. 08/878,598 entitled "Contact Position Indicator for an Industrial-Rated Circuit Breaker" describes the use of a target device to indicate the condition of the circuit breaker contacts as well as an interlock arrangement for preventing false indication thereof.

Various accessory devices are used with such air circuit breakers to provide auxiliary function along with overcurrent protection. One such accessory is the bell alarm accessory that provides local and remote indication as to the occurrence of circuit interruption. U.S. Pat. No. 5,502,286 entitled "Bell Alarm and Lock-Out for High Ampere-Rated Circuit Breakers" describes a bell alarm accessory used with so-called "insulated case" circuit breakers wherein the circuit breaker interrupting components are completely enclosed within an insulating plastic enclosure. This patent describes one such bell alarm accessory that interacts with the circuit breaker operating mechanism to activate the bell alarm upon circuit interruption and to prevent the closing of the circuit breaker contacts until the accessory is manually reset.

U.S. patent application Ser. No. 08/878,595 entitled "Circuit Breaker Bell Alarm Accessory with Lockout" provides a bell alarm accessory that provides local as well as remote indication of such circuit interruption as well as preventing circuit breaker contact closure until and unless the accessory has become manually reset.

In most circuit breakers employing a bell alarm for status indication of the circuit breaker contacts, it is a requirement that the circuit breaker operating mechanism be reset before the bell alarm can be manually reset to indicate the circuit breaker closed condition. It would be more convenient, in certain applications, to allow the bell alarm accessory to become automatically reset immediately upon closure of the circuit breaker contacts without the requirement of manual intervention.

U.S. patent application Ser. No. 08/904,324 entitled "Circuit Breaker Bell Alarm Accessory with Automatic Reset" filed on Jul. 31, 1997 describes a bell alarm accessory that is automatically reset upon response of the circuit breaker operating mechanism to close the circuit breaker contacts.

In certain industrial processes, the requirement with respect to the bell alarm accessory function may change in accordance with the process requirements. It would be advantageous to have a circuit breaker bell alarm accessory that can change function as well as to return to the early function without having to dismantle the circuit breaker operating mechanism enclosure to remove or to assemble separate bell alarm accessory units.

One purpose of the invention is to provide a multifunctional bell alarm unit that is capable of both automatic reset along with lock-out facility whereby either option can be adopted by a minor adjustment to a common bell alarm unit.

SUMMARY OF THE INVENTION

An air circuit breaker bell alarm unit interacts with the circuit breaker components to provide local and remote indication of the occurrence of a circuit interruption. The signal flag in the form of a pop-up target arranged at the top part of a bell alarm accessory projects through an opening in the circuit breaker cover to provide visual indication of the occurrence of a circuit interruption. A plunger extending from the bottom of the bell alarm accessory interacts with the circuit breaker components to optionally reset the pop-up target in the early stages of the closing of the circuit breaker contacts or to lock-out the closing of the circuit breaker contacts until the pop-up target is manually reset. The positional placement of the bell alarm accessory on the bell alarm unit support plate determines the lock-out or reset selection.

DESCRIPTION OF THE PREFERRED EMBODIMENT

Figure 1:
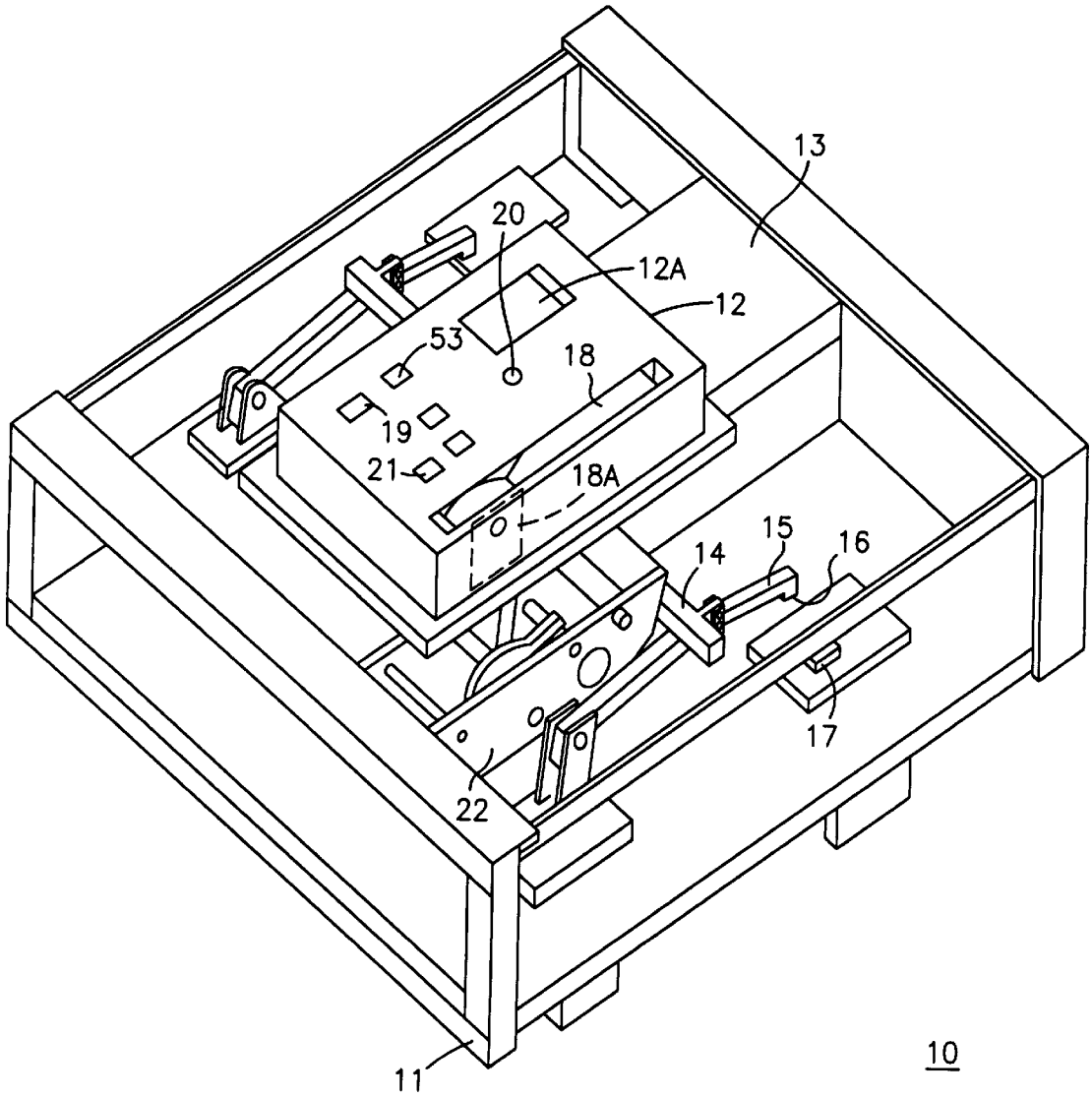
FIG. 1 is top perspective view of an air circuit breaker containing the multifunction bell alarm unit in accordance with the invention.

The air circuit breaker 10 of FIG. 1 is similar to that described within the aforementioned U.S. Pat. No. 3,095,489 and includes a metal frame 11 which supports the trip unit programmer 12A and the operating mechanism enclosure 13. The trip unit programmer is similar to that described in U.S. Pat. No. 4,672,501 entitled "Circuit Breaker and Protective Relay Unit". The circuit breaker cover 12 includes a trip button 19 for releasing the circuit breaker operating mechanism contained within the enclosure 13 for separating the circuit breaker contacts 16, 17 to their open condition and a closing button 21 for moving the contacts to their closed position. The circuit breaker contact arms 15 within each pole of a three pole circuit arrangement, are interconnected by means of the operating mechanism crossbar 14 to insure that all contacts within the separate poles both open and close in unison. The ratchet mechanism 22 improves over the earlier mechanism described in U.S. Pat. No. 4,167,988 entitled "Ratcheting Mechanism for a Circuit Breaker Motor Operator" by allowing the operating mechanism closing spring described therein to be charged remotely by means of a motor operator as well as by means of the circuit breaker operating handle 18 that interacts with the ratchet mechanism 22 by means of a pair of plate connectors, one of which is indicated at 18A. The condition of the circuit breaker contacts is visually ascertained by means of the circuit breaker target plate 32 (FIG. 2) which is visible through apertures 53 (also in FIG. 2) formed in the circuit breaker cover 12. The occurrence of contact separation caused by an overcurrent condition within a protected circuit to which the circuit breaker is connected is depicted by transfer of the pop-up target 28 through the indicator aperture 20 formed in the circuit breaker cover 12 as best seen by now referring to the circuit breaker 10 as depicted in FIG. 2.

Figure 2:
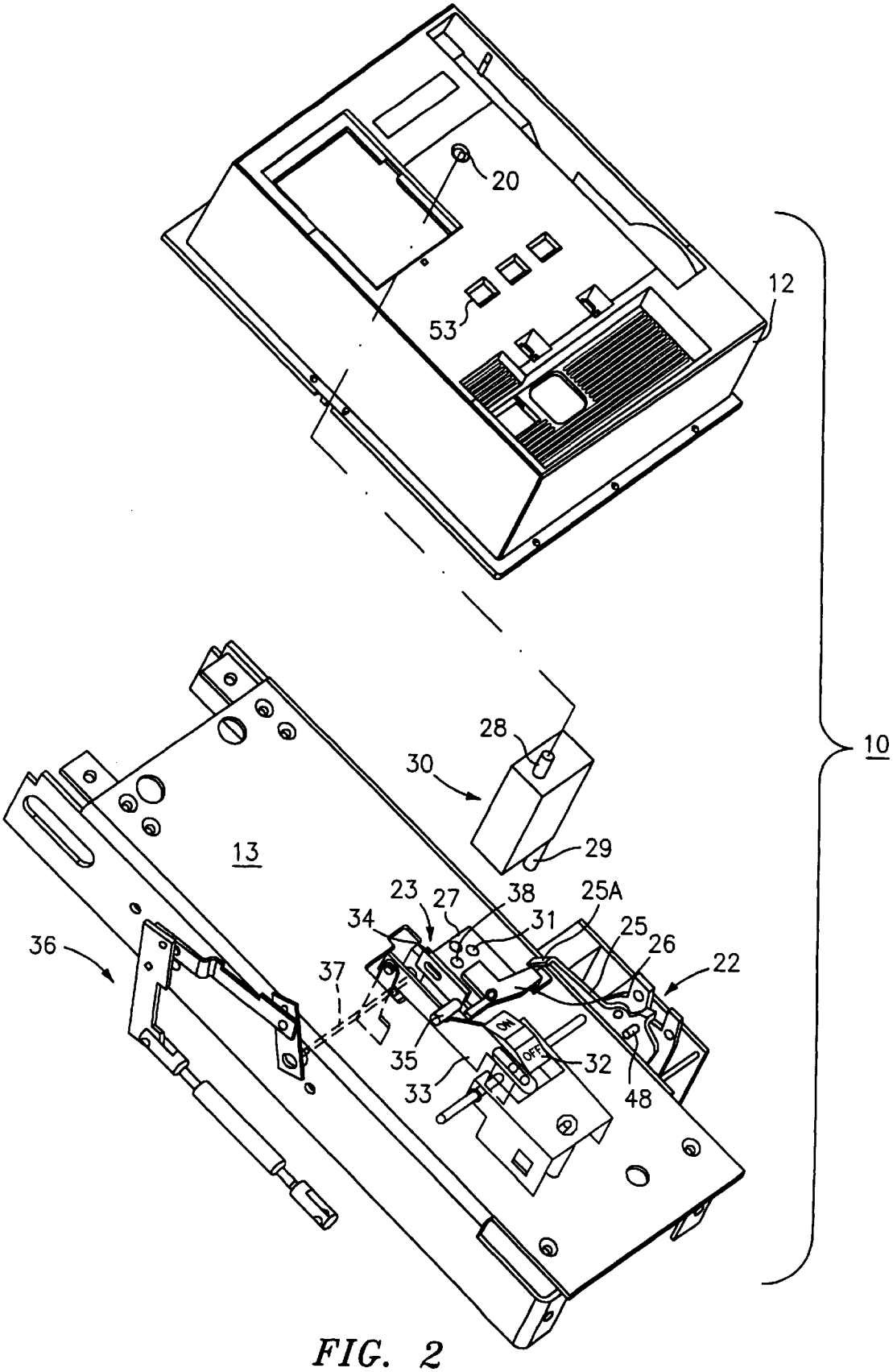
FIG. 2 is a top perspective view of the circuit breaker of FIG. 1 with the circuit breaker cover removed to detail the bell alarm accessory in isometric relation with the multifunction bell alarm unit on the circuit breaker operating mechanism enclosure.

The circuit breaker 10 of FIG. 1 is depicted in FIG. 2 with the circuit breaker cover 12 removed from the circuit breaker operating mechanism enclosure 13 to illustrate the position of the multifunction bell alarm unit 23, hereinafter "bell alarm unit", as arranged on the surface thereof intermediate the ratchet mechanism 22, which is described in U.S. patent application Ser. No. 08/863,649 entitled "Ratcheting Mechanism for Industrial-Rated Circuit Breaker" and the movable contact arm linkage 36, described in the aforementioned U.S. patent application Ser. No. 08/878,598. The contact arm linkage 36 connects with the trip indicator drive lever 33 by means of the connector rod 37 to set the position of the target plate 32 relative to the circuit breaker contacts 16, 17 (FIG. 1). The bell alarm unit 23, attached to the operating mechanism enclosure 13 by means of the bell alarm unit support plate 27, interacts with the trip indicator drive lever 33 by capture of the drive pin 35, extending from the reset drive slide 34, within the trip indicator drive lever 33. The bell alarm accessory 30 having a pop-up target 28 extending from the top and a plunger 29 extending from the bottom is positioned on the support plate 27 by insertion of the plunger 29 within the reset thru-hole 38, formed in the support plate 27 and aligning the pop-up target 28 under the indicator aperture 20 in the circuit breaker cover 12 in the manner described within the aforementioned U.S. patent application Ser. No. 08/904,324 when reset function is desired. The bell alarm unit further interacts with the ratchet mechanism 22 by means of the lockout actuator arm 26, blocking prop 25 and the closing pin 48 to provide bell alarm accessory lockout function by insertion of the plunger 29 within the lockout thru-hole 31 formed in the support plate 27 and aligning the pop-up target 28 under the indicator aperture 20 in the manner described within the aforementioned U.S. patent application Ser. No. 08/878,595 when lockout function is desired.

Figure 3:
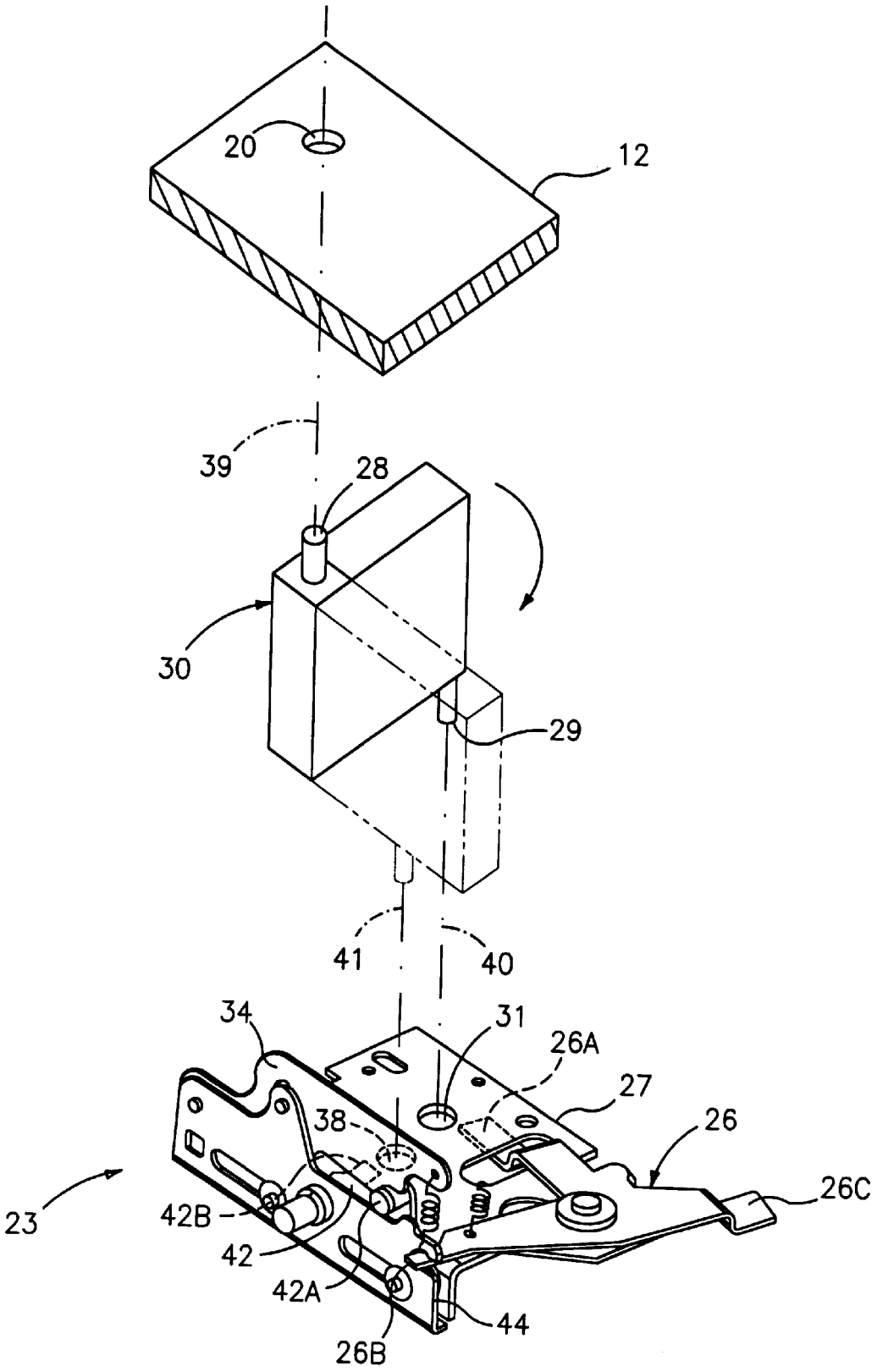
FIG. 3 is an exploded top perspective view of the bell alarm accessory in isometric projection with the multifunction bell alarm unit of FIG. 2.

The positional relationship between the indicator aperture 20 in the circuit breaker cover 12, the pop-up target 28 and plunger 29 on the bell alarm accessory 30 and the lockout thru-hole 31 and the reset thru-hole 38 in the bell alarm unit 23 is best seen by referring now to FIG. 3.

When bell alarm lockout function is selected, the plunger 29 is inserted within the lockout thru-hole 31 in the support plate 27, which positions the plunger along the lockout guide line 40 relative to one tab 26A of the actuator arm 26. Another tab 26B on the actuator arm 26 is positioned on the reset drive slide 44 while the remaining tab 26C interacts with the tab 25A on the end of the blocking prop 25 of FIG. 2 to provide the lockout function as described within the aforementioned U.S. patent application Ser. No. 08/878,595.

When bell alarm reset function is selected, the plunger 29 is rotated to the position indicated in phantom and is inserted within the reset thru-hole 38 in the support plate 27, which positions the plunger along the guide line 41 relative to the reset actuator tab 42B on the end of the reset actuator arm 42 to provide the reset function via the reset pin 42A and the reset drive link 34 as described within the aforementioned U.S. patent application Ser. No. 08/904,324. It is noted that the pop-up target 28 remains in line with the center line 39 through the indicator aperture 20 in the circuit breaker cover 12 whether the lockout function or reset function is selected.

Figure 4:
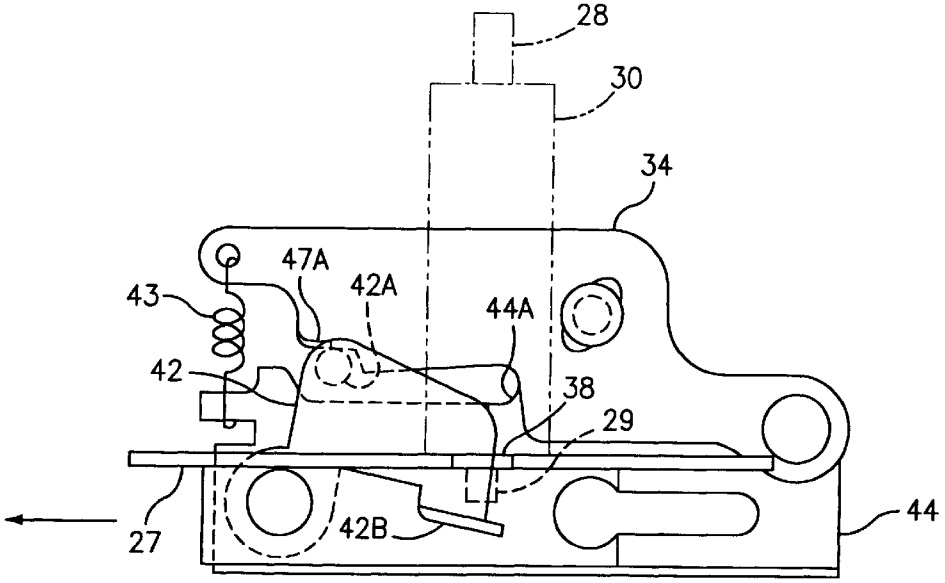
FIG. 4 is an enlarged side view of the multifunction bell alarm unit of FIG. 2 depicting the automatic bell alarm accessory reset function.

The positional relationship between the bell alarm unit 23 and the bell alarm accessory 30 when the reset function is selected by position of the plunger 29 on the end of the bell alarm accessory opposite the pop-up target 28 within the reset thru-hole 38 in the support plate 27 is shown in FIG. 4. The plunger 29 is shown in the drop-out position away from the reset actuator tab 42B on the end of the reset actuator arm 42 and the reset pin 42A extends between the cam surface 47A on bottom of the reset driver link 34 and linear surface 44A on the top of the reset drive slide 44 under the urgence of the reset spring 43 as described in the aforementioned U.S. patent application Ser. No. 08/904,324 in greater detail.

Figure 5:
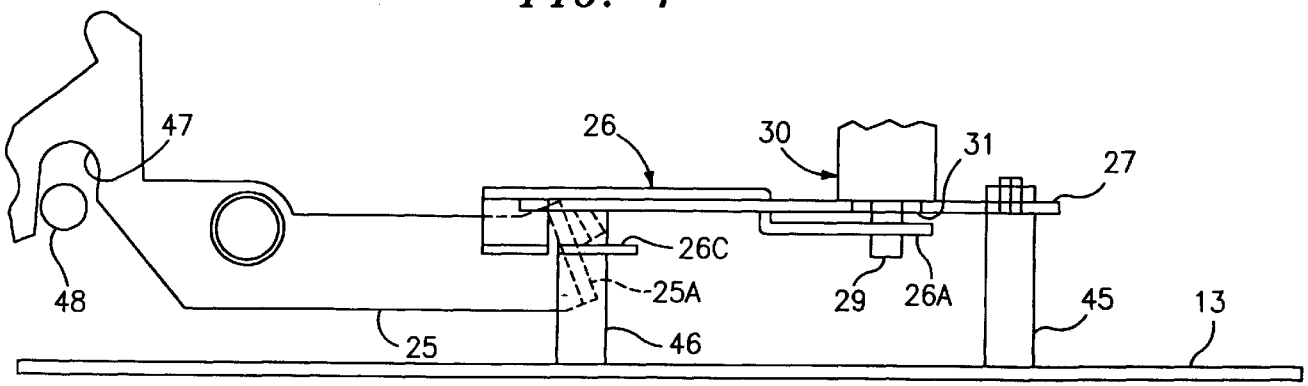
FIG. 5 is an enlarged side view of the multifunction bell alarm unit of FIG. 2 depicting the lock-out bell alarm accessory function.

The positional relationship between the bell alarm unit 23 and the bell alarm accessory 30 when the lockout function is selected by position of the plunger 29 within the lockout thru-hole 31 in the support plate 27, which is attached to the circuit breaker operating mechanism enclosure 13 by standoffs 45, 46 is shown in FIG. 5. The bell alarm accessory 30 is in the lockout mode with the plunger 29 against the tab 26A at the end of the lockout actuator arm 26. The blocking tab 25A at the end of the blocking prop 25 is in contact with the tab 26C on the end of the lockout actuator arm 26 while the closing pin 48 is engaged within the slot 47 on the opposite end of the blocking prop 25 as described in the aforementioned U.S. patent application Ser. No. 08/878,595 in greater detail.

It has thus been shown that a multifunction bell alarm unit containing both bell alarm reset function as well as circuit breaker contact lockout function can be used within a common circuit breaker environment. The positioning of the bell alarm accessory relative to the bell alarm unit components governs whether lockout or reset function is enabled.

We claim:

1. A multifunction bell alarm unit comprising:

a support plate supporting a circuit breaker bell alarm accessory having a pop-up target extending from a top part and a plunger extending from a bottom part thereof;

a reset driver slide slidably mounted to said support plate, said driver slide having a driver pin extending from one side for interaction with a circuit breaker indicator assembly;

a reset drive link pivotally attached to said driver slide, said drive link having a cam surface for interacting with a reset actuator arm having a reset pin and a reset tab for interacting with said plunger, whereby said bell alarm pop-up target becomes reset prior to closure of a pair of associated circuit breaker contacts;

a reset thru-hole within said support plate, said plunger extending through said reset thru-hole when bell alarm self-resetting function is selected;

a lock-out actuator arm mounted to said support plate, said actuator arm arranged for interacting with a circuit breaker blocking prop at one end thereof and a lockout tab at an opposite end, said lockout tab arranged for interfering with said plunger to prevent reset of said pop-up target; and a lockout thru-hole within said support plate, said plunger extending through said lock-out thru-hole when bell alarm lockout function is selected.

2. The bell alarm unit of claim 1 wherein said reset tab is proximate said reset thru-hole and said lock-out tab is proximate said lock-out thru-hole.

3. The bell alarm unit of claim 1 wherein said reset drive link defines a cam surface formed thereon, said reset pin being trapped between said reset drive link cam surface and a top part of said reset driver slide.

4. The bell alarm unit of claim 3 wherein said reset pin moves along said cam surface in cam-follower relation.

5. The bell alarm unit of claim 1 wherein said support plate is attached to a circuit breaker operating mechanism enclosure by a stand-off connector.

6. The bell alarm unit of claim 1 wherein said pop-up target extends within a common aperture within a circuit breaker cover when said plunger extends through one of said reset thru-hole and said lock-out thru-hole.

7. A circuit breaker comprising:

a pair of contacts arranged at a first end of a contact arm;

a circuit breaker operating mechanism cross bar for moving said contacts between closed and open positions;

a circuit breaker cover arranged over an operating mechanism enclosure;

a bell alarm unit on an apertured support plate intermediate said operating mechanism enclosure and said circuit breaker cover, said bell alarm unit providing indication when said contacts are in said closed and open conditions;

a circuit breaker bell alarm accessory having a pop-up target extending from a top part through an aperture in said circuit breaker cover and a plunger extending from a bottom part;

said plunger being arranged through a reset thru-hole in said support plate when automatic reset function is selected, whereby said pop-up target is automatically reset when said contacts are first moved to said closed condition; and said plunger being arranged through a lock-out thru-hole in said support plate when lockout function is selected, whereby said contacts are prevented from moving to said closed condition until said pop-up target is manually reset.

8. The circuit breaker of claim 7 wherein said bell alarm unit includes a reset driver slide slidably mounted to said support plate, said driver slide having a driver pin extending from one side for interaction with a circuit breaker indicator assembly.

9. The circuit breaker of claim 8 wherein said bell alarm unit includes a reset drive link pivotally attached to said driver slide at one end whereby said bell alarm pop-up target becomes reset prior to closing of said circuit breaker contacts.

10. The circuit breaker of claim 9 wherein said driver slide having a cam-surface for interacting with a reset actuator arm having a rest pin and a rest tab for interacting with said plunger, whereby said interaction between said reset actuator arm and said plunger causes said bell alarm pop-up target to reset prior to closure of said circuit breaker contacts.

11. The circuit breaker of claim 10 wherein said reset drive link defines a cam surface formed thereon, said reset pin being trapped between said reset drive link cam surface and a top part of said reset driver slide.

12. The circuit breaker of claim 10 wherein said bell alarm unit includes a lock-out actuator arm mounted to said support plate, said actuator arm arranged for interacting with a circuit breaker blocking prop at one end thereof and a lockout tab at an opposite end, said lockout tab arranged for interfering with said plunger to prevent reset of said pop-up target.

13. The circuit breaker of claim 12 wherein said reset tab is proximate said reset thru-hole and said lock-out tab is proximate said lock-out thru-hole.

14. The circuit breaker of claim 13 wherein said reset pin moves along said cam surface in cam-follower relation.

15. The circuit breaker of claim 7 wherein said support plate is attached to a circuit breaker operating mechanism enclosure by a stand-off connector.

16. The circuit breaker of claim 7 wherein said pop-up target extends within a common aperture within a circuit breaker cover when said plunger extends through said reset thru-hole when automatic reset function is selected and said plunger extends through said lock-out thru-hole when lock-out function is selected.

* * * * *